US008746202B2

(12) United States Patent
Ogura

(10) Patent No.: US 8,746,202 B2
(45) Date of Patent: Jun. 10, 2014

(54) LUBRICATION SYSTEM OF AN INTERNAL COMBUSTION ENGINE

(75) Inventor: Seiji Ogura, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 265 days.

(21) Appl. No.: 13/259,694

(22) PCT Filed: Mar. 26, 2009

(86) PCT No.: PCT/JP2009/056091
§ 371 (c)(1),
(2), (4) Date: Nov. 28, 2011

(87) PCT Pub. No.: WO2010/109622
PCT Pub. Date: Sep. 30, 2010

(65) Prior Publication Data
US 2012/0067321 A1 Mar. 22, 2012

(51) Int. Cl.
*F01M 1/02* (2006.01)
*F01M 1/04* (2006.01)

(52) U.S. Cl.
USPC ..... 123/196 R; 123/196 CP

(58) Field of Classification Search
USPC ..... 123/196 R, 198 D, 196 S; 184/6.5
See application file for complete search history.

(56) References Cited

U.S. PATENT DOCUMENTS

2006/0175039 A1 8/2006 Nagashima et al.

FOREIGN PATENT DOCUMENTS

| | | |
|---|---|---|
| EP | 1 936 135 A1 | 6/2008 |
| JP | U-61-33909 | 3/1986 |
| JP | U-61-033909 | 3/1986 |
| JP | A-4-17708 | 1/1992 |
| JP | A-2006-83782 | 3/2006 |
| JP | A-2006-168701 | 6/2006 |
| JP | A-2007-297961 | 11/2007 |

OTHER PUBLICATIONS

International Search Report mailed Apr. 28, 2009 issued in International Patent Application No. PCT/JP2009/056091 (with translation).
Oct. 23, 2012 Excerpt of Extended European Search Report.

*Primary Examiner* — Noah Kamen
(74) *Attorney, Agent, or Firm* — Oliff PLC

(57) ABSTRACT

A technique which is capable of suppressing a deterioration of lubricating oil used in an internal combustion engine in a more suitable manner. The present invention is provided with an oil pump, oil pressure control means to control the oil pressure of the oil pump, and a determination means to determine whether the degree of deterioration of the lubricating oil is higher than a predetermined level. When it is determined that the degree of deterioration of the lubricating oil is higher than the predetermined level, the oil pressure of the oil pump is made lower, by means of the oil pressure control means, than that at the time when the degree of deterioration of the lubricating oil is equal to or lower than the predetermined level.

6 Claims, 7 Drawing Sheets

LUBRICATION SYSTEM OF AN INTERNAL COMBUSTION ENGINE

TECHNICAL FIELD

The present invention relates to a lubrication system which supplies lubricating oil to an internal combustion engine.

BACKGROUND ART

In recent years, in order to improve the fuel economy performance of an internal combustion engine, it is intended to make lower the viscosity of lubricating oil to be used. However, when the original viscosity of lubricating oil is low, it becomes easy to cause cutting or shortage of an oil film due to a deterioration of the lubricating oil. When an oil film shortage occurs, friction in sliding parts of the internal combustion engine rather increases, thus giving rise to a fear that a large deterioration of fuel mileage may be caused.

In a Patent Document 1, there is disclosed a technique that cools lubricating oil by cooling an oil pan by means of cooling water, thereby preventing the deterioration of the lubricating oil. However, when the lubricating oil is cooled excessively, the viscosity of the lubricating oil goes up to an excessive extent, as a result of which an increase in friction will be caused. In addition, when the viscosity of the lubricating oil goes up to an excessive extent, the work load of an oil pump will increase, which will also become a cause for fuel mileage deterioration.

Patent Document 1: Japanese patent application laid-open No. 2006-168701

DISCLOSURE OF THE INVENTION

Problems to be Solved by the Invention

The present invention has for its object to provide a technique which is capable of suppressing the deterioration of lubricating oil used in an internal combustion engine in a more suitable manner.

Means for Solving the Problems

The present invention suppresses a temperature rise of lubricating oil by decreasing the oil pressure of an oil pump, thereby suppressing the deterioration of the lubricating oil.

More specifically, a lubrication system of an internal combustion engine according to the first invention is characterized by comprising:

an oil pump that pressure feeds lubricating oil to be supplied to the internal combustion engine;

an oil pressure control unit that controls the oil pressure of the oil pump; and a determination unit that determines whether the degree of deterioration of the lubricating oil is higher than a predetermined level;

wherein when it is determined by said determination unit that the degree of deterioration of the lubricating oil is higher than said predetermined level, the oil pressure of said oil pump is made lower, by means of said oil pressure control unit, than that at the time when the degree of deterioration of the lubricating oil is equal to or lower than said predetermined level.

Here, the predetermined level is a threshold value which is used to be able to make a judgment that it is necessary to suppress the promotion of a further deterioration of the lubricating oil. The predetermined level can be beforehand set based on experiments, etc.

According to the present invention, when the degree of deterioration of the lubricating oil is higher than the predetermined level, the temperature rise of the lubricating oil can be suppressed. As a result, the promotion of deterioration of the lubricating oil can be suppressed.

In addition, according to the present invention, an excessive temperature drop is difficult to occur while suppressing the temperature rise of the lubricating oil, so it is possible to suppress an excessive increase in viscosity of the lubricating oil. Accordingly, the deterioration of fuel economy or mileage can be suppressed. Further, because the oil pressure control of the oil pump is highly responsive, it is possible to achieve the control for the suppression of deterioration of the lubricating oil at a desired timing.

Moreover, when the oil pressure of the oil pump is made low, the work load thereof will be decreased. For that reason, in cases where the oil pump is a mechanical pump with its drive source being the output of the internal combustion engine, fuel mileage can also be improved by making the oil pressure lower.

Here, when the oil pressure of the oil pump is made lower, the amount of lubricating oil supplied to the internal combustion engine is decreased, so there is a fear that the lubricating oil may run short in a high load range and in a high rotation region. Accordingly, in the present invention, when the engine load of the internal combustion engine is equal to or higher than a predetermined load, or when the number of revolutions per unit time of the internal combustion engine is equal to or more than a predetermined number of revolutions per unit time, it may be possible to inhibit the control to make the oil pressure of the oil pump lower, even in cases where it is determined by the determination unit that the degree of deterioration of the lubricating oil is higher than the predetermined level. As a result of this, it is possible to suppress the shortage of the lubricating oil.

A lubrication system of an internal combustion engine according to the second invention is characterized by comprising:

an oil pump that pressure feeds lubricating fluid to be supplied to the internal combustion engine;

an oil pressure control unit that controls the oil pressure of the oil pump; and a deterioration degree obtaining unit that obtains the degree of deterioration of the lubricating fluid;

wherein the higher the degree of deterioration of the lubricating fluid, the lower the oil pressure of said oil pump is made.

According to this aspect of the present invention, too, it is possible to suppress the promotion of deterioration of lubricating oil or fluid.

In addition, in the first and second inventions, the oil pressure of the oil pump may be caused to decrease to or below a predetermined pressure each time a predetermined period of time elapses, without regard to the degree of deterioration of the lubricating oil or fluid. As a result, the promotion of deterioration of the lubricating oil or fluid can be suppressed to a further extent.

Effect of the Invention

According to the present invention, the deterioration of lubricating oil used in an internal combustion engine can be suppressed in a more suitable manner.

EXPLANATION OF REFERENCE NUMERALS

Figure 1:
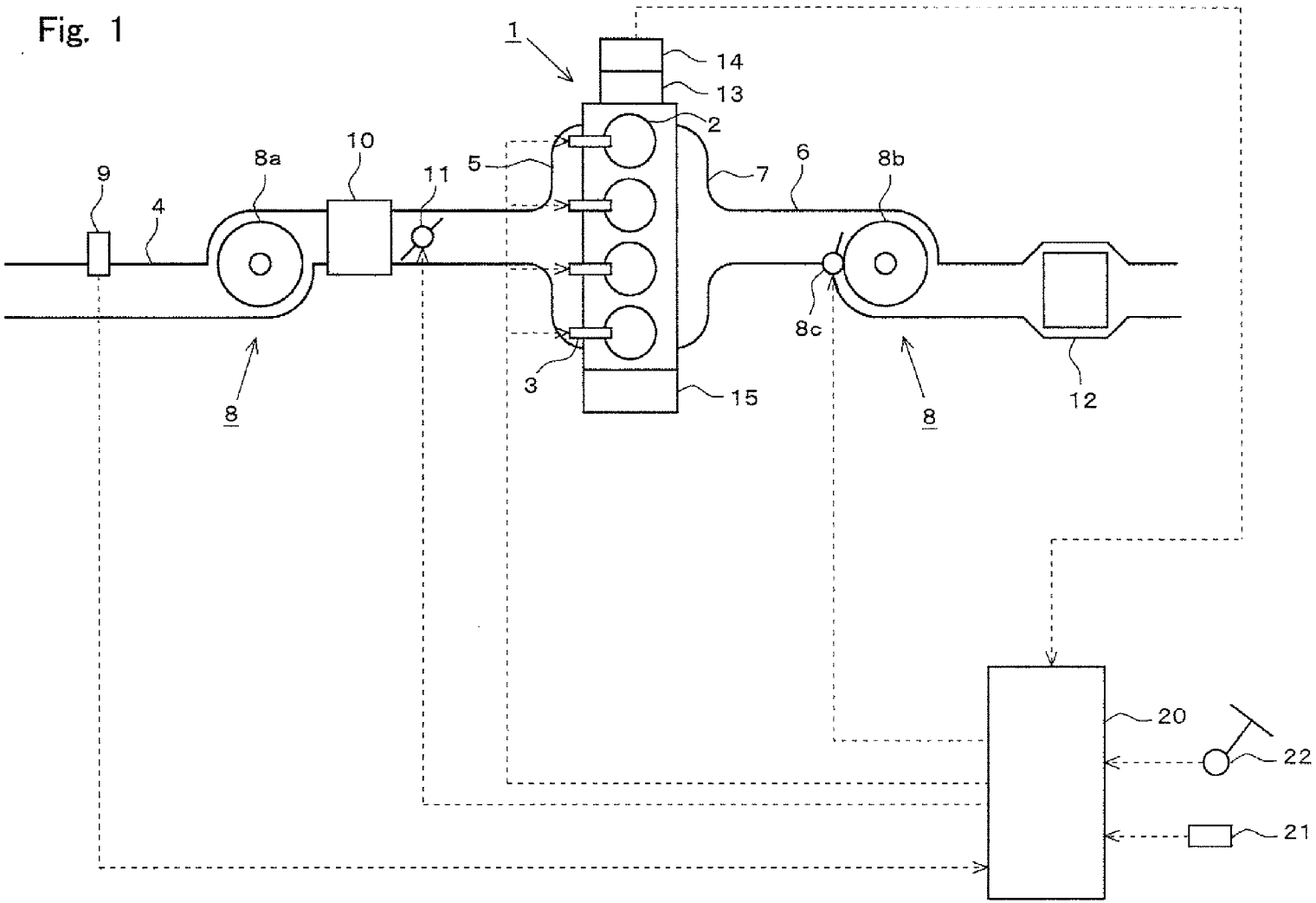
FIG. 1 is a view showing the schematic construction of an internal combustion engine and its intake and exhaust systems according to a first embodiment of the present invention.

1 internal combustion engine
2 cylinder(s)
4 intake passage
6 exhaust passage
14 rotational variation sensor
15 oil pump
16 oil pan
17 relief valve
18 oil control valve
20 ECU
21 vehicle speed sensor
22 accelerator opening sensor

BEST MODE FOR CARRYING OUT THE INVENTION

Hereinafter, specific embodiments of the present invention will be described based on the attached drawings. However, the dimensions, materials, shapes, relative arrangements and so on of component parts described in the embodiments are not intended to limit the technical scope of the present invention to these alone in particular as long as there are no specific statements.

First Embodiment

Reference will be made to a first embodiment of the present invention based on FIGS. 1 through 4.

(Schematic Construction of an Internal Combustion Engine and Intake and Exhaust Systems)

FIG. 1 is a view showing the schematic construction of an internal combustion engine and its peripheral systems according to this first embodiment. The internal combustion engine 1 is a diesel engine having four cylinders 2. Each of the cylinders 2 is provided with a fuel injection valve 3 that directly injects fuel into the interior of a corresponding cylinder 2. The individual cylinders 2 are connected with an intake manifold 5 through unillustrated intake ports, respectively. The intake manifold 5 is connected to an intake passage 4. An air flow meter 9, a compressor 8*a* of a turbocharger 8, an intercooler 10, and a throttle valve 11 are arranged in the intake passage 4 sequentially from an upstream side.

In addition, the individual cylinders 2 are connected with an exhaust manifold 7 through unillustrated exhaust ports, respectively. The exhaust manifold 7 is connected to an exhaust passage 6. A turbine 8*b* of the turbocharger 8 and an exhaust gas purification device 12 are arranged in the exhaust passage 6. The turbine 8*b* is provided with a variable nozzle vane 8*c*. As the exhaust gas purification device 12, there can be exemplified one which is composed of an oxidation catalyst, a NOx storage reduction catalyst, a particulate filter, and so on.

An acceleration sensor 13 and a rotational variation sensor 14 are mounted on the internal combustion engine 1. Also, an oil pump 15 for pressure feeding lubricating oil is mounted on the internal combustion engine 1. This oil pump 15 is a mechanical pump which is driven to operate by rotation of a crankshaft of the internal combustion engine 1, and in which oil pressure can be changed by means of an arrangement to be described later.

In the internal combustion engine 1, there is arranged in combination therewith an electronic control unit (ECU) 20 which is a computer unit for controlling the operating state of the internal combustion engine 1. In addition to the air flow meter 9, the acceleration sensor 13 and the rotational variation sensor 14, a vehicle speed sensor 21 and an accelerator opening sensor 22, which are provided on a vehicle having the internal combustion engine 1 mounted thereon, are electrically connected to the ECU 20. The output signals of these sensors are inputted to the ECU 20. In addition, the fuel injection valves 3, the throttle valve 11, and the variable nozzle vane 8*c* are electrically connected to the ECU 20. These elements are controlled by means of the ECU 20.

(Schematic Construction of a Lubrication System of an Internal Combustion Engine)

Figure 2:
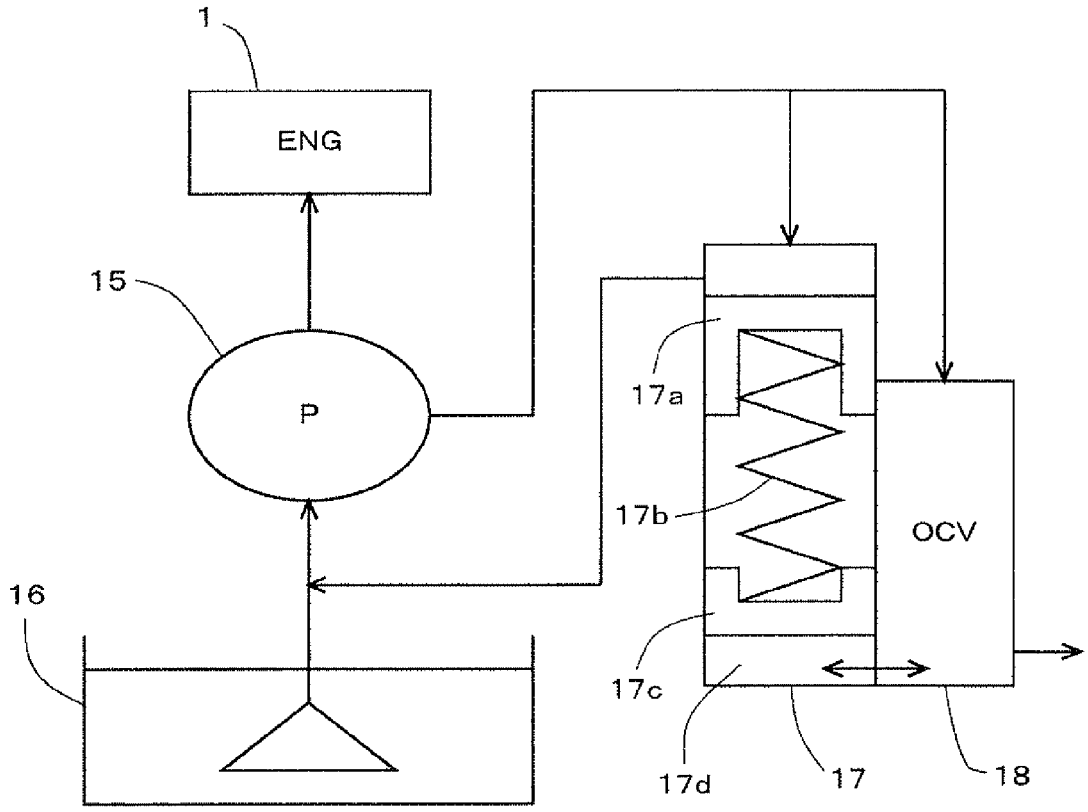
FIG. 2 is a view showing the schematic construction of a lubrication system of the internal combustion engine according to the first embodiment.

FIG. 2 is a view showing the schematic construction of a lubrication system of an internal combustion engine according to this embodiment. Arrows in FIG. 2 represent flow paths of lubricating oil. In this embodiment, the lubricating oil collected in an oil pan 16 is pressure fed by the oil pump 15, so that it is supplied to individual sliding portions of the internal combustion engine 1.

In addition, a relief valve 17 is arranged in combination with the oil pump 15, and the lubricating oil pressure fed by the oil pump 15 is also supplied to this relief valve 17. Moreover, in order to control the oil pressure of the oil pump 15 in a variable manner, an oil control valve (hereinafter referred to as an OCV) 18 is arranged in combination with the relief valve 17. The lubricating oil pressure fed by the oil pump 15 is also supplied to this OCV 18 as operation oil.

In the inside of the relief valve 17, a valve body 17*a* is resiliently urged by a spring 17*b*. When the oil pressure of the oil pump 15 goes up so that the pressure of lubricating oil supplied to the relief valve 17 becomes larger than the resilient force of the spring 17*b*, the valve body 17*a* is opened (is moved to a lower side in FIG. 2). As a result of this, the lubricating oil supplied to the relief valve 17 is caused to return to an upstream side of the oil pump 15.

Further, in the inside of the relief valve 17 according to this embodiment, the spring 17*b* has its one end, which is opposite to its other end connected with the valve body 17*a*, connected with a retainer 17*c*. This retainer 17*c* is slidable, similar to the valve body 17*a*. Then, a sub-chamber 17*d* is formed in the inside of the relief valve 17 at a lower side of the retainer 17*c*.

The sub-chamber 17*d* is in communication with the OCV 18, so that the lubricating oil supplied to the OCV 18 is able to go back and forth between the OCV 18 and the sub-chamber 17*d*. The OCV 18 is electrically connected to the ECU 20. The oil pressure of the oil pump 15 is controlled by controlling the OCV 18 by means of the ECU 20.

For example, when lubricating oil is supplied to the sub-chamber 17*d* from the OCV 18 (hereinafter, this state being referred to as OCV-OFF), the retainer 17*c* will be located at an upper side in the inside of the relief valve 17. With this, the resilient force of the spring 17*b* becomes high or large. As a result, the valve opening pressure of the valve body 17*a* is made high, so the oil pressure of the oil pump 15 becomes high.

On the other hand, when lubricating oil is discharged from the sub-chamber 17*d* into the OCV 18 (hereinafter, this state being referred to as OCV-ON), the retainer 17*c* will be located at a lower side in the inside of the relief valve 17. With this, the resilient force of the spring 17*b* becomes low or small. As a result, the valve opening pressure of the valve body 17*a* is made low, so the oil pressure of the oil pump 15 becomes low.

Here, note that in this embodiment, the relief valve 17 and the OCV 18 correspond to an oil pressure control unit according to the present invention.

In addition, a method of controlling the oil pressure of the oil pump 15 according to this embodiment is not limited to the above-mentioned method. For example, in cases where an electric pump is used as the oil pump 15, the oil pressure thereof can be controlled by means of the ECU 20.

(Determination of the Deterioration of Lubricating Oil)

In this embodiment, in order to intend to improve fuel mileage, a low-viscosity oil is used as the lubricating oil. In addition, in this embodiment, the determination of the deterioration of the lubricating oil is carried out based on the friction of the internal combustion engine. More specifically, the friction of the internal combustion engine 1 is calculated in a low load operation state and in a high load operation state, and it is determined, based on the relation between the frictions in the individual operating states, whether the degree of deterioration of the lubricating oil is higher than a predetermined level. Here, the predetermined level is a threshold value which is used to be able to make a judgement that it is necessary to suppress the promotion of a further deterioration of the lubricating oil. The predetermined level can be beforehand set based on experiments, etc.

As a method of calculating the friction in the low load operation state, there can be exemplified the following method. That is, at the time of decelerating operation (at the time of fuel cut-off operation), a very small amount of fuel injection, which does not influence engine torque, is carried out, and the rotational variation torque in that case is measured by the rotational variation sensor 14. Then, a difference between this measured value and a theoretical value of the torque corresponding to the very small amount of fuel injection is calculated as the friction in the low load operation state.

As a calculation method of friction in friction measurements in the high load operation state, there can be exemplified the following method. That is, at the time of accelerating operation, a vehicle speed change before and after the elapse of a predetermined time (several seconds) is measured by means of the vehicle speed sensor 21, and an acceleration torque is calculated from the relation between an acceleration and an amount of fuel injection during that time. Then, a difference between a calculated value of the acceleration torque and a theoretical value of the acceleration torque corresponding to the amount of fuel injection at the time of acceleration is calculated as the friction in the high load operation state.

Figure 3:
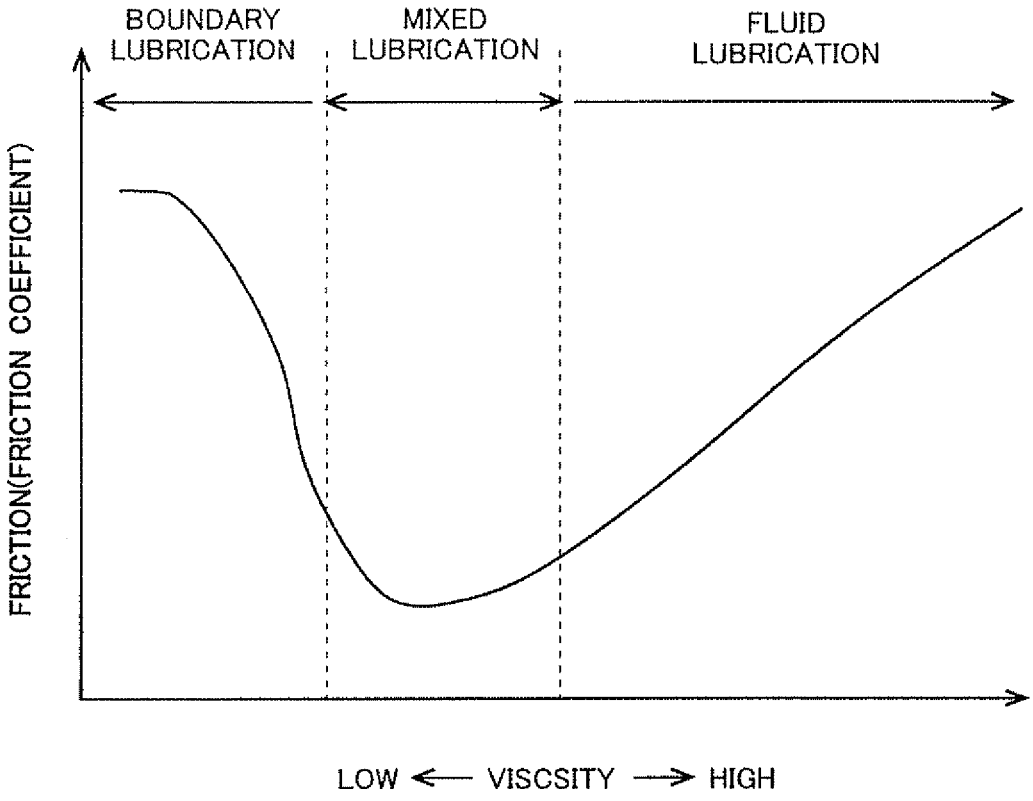
FIG. 3 is a view showing the relation between friction and the viscosity of lubricating oil according to the first embodiment.

Here, the relation between the friction and the viscosity of the lubricating oil will be explained based on FIG. 3. In FIG. 3, the axis of ordinate represents the friction (the coefficient of friction), and the axis of abscissa represents the viscosity of the lubricating oil. As shown in FIG. 3, in a region (boundary lubrication region) in which the viscosity of the lubricating oil is excessively low, the friction becomes large to a substantial extent. On the other hand, in a region (fluid lubrication region) in which the viscosity of the lubricating oil is high to some extent, the higher the viscosity of lubricating oil, the larger the friction becomes.

In the ordinary case, the low-viscosity oil used in this embodiment has a viscosity in a mixed lubrication region. For that reason, when the viscosity of the oil becomes further lower due to the deterioration thereof, it will become a value within the boundary lubrication region, and the friction will increase. However, the temperature of the internal combustion engine 1 is low in the low load operating state, so when the degree of deterioration of the low-viscosity oil is low, the viscosity thereof becomes a value in the fluid lubrication region. For that reason, when the viscosity of the low-viscosity oil becomes further lower due to the deterioration thereof, it will become a value within the mixed lubrication region, and the friction will decrease on the contrary.

Accordingly, in the deterioration determination of lubricating oil according to this embodiment, in cases where the friction in the low load operating state is equal to or less than a predetermined determination value and the friction in the high load operating state is above the predetermined determination value, a determination is made that the degree of deterioration of the lubricating oil is higher than the predetermined level.

On the other hand, in cases where the friction in the low load operating state and the friction in the high load operating state are equal to or less than the predetermined determination value, a determination is made that the degree of deterioration of the lubricating oil is equal to or less than the predetermined level.

In addition, in cases where the friction in the low load operating state and the friction in the high load operating state are above the predetermined determination value, it can be judged that the increase of the friction results from an abnormality of the internal combustion engine 1 itself, such as damage to a piston ring, a cylinder liner (bush), or the like. For that reason, in this case, it is determined that an abnormality has occurred in the internal combustion engine 1.

By carrying out a deterioration determination on the lubricating oil according to the above method, it is possible to determine whether the degree of deterioration of the lubricating oil is higher than the predetermined level, in distinction from the abnormality of the internal combustion engine 1 itself.

Here, note that the method of determining the deterioration of lubricating oil according to this embodiment is not limited to the above-mentioned method. For example, there can also be applied a method of carrying out a deterioration determination on lubricating oil by comparing an amount of fuel injection in an idle operation state with an amount of idle fuel injection (an amount of idle fuel injection at the time when the deterioration of lubricating oil has not occurred (at the time of a new article)) which is a reference value. However, according to the above-mentioned method, it becomes possible to carry out the deterioration determination of lubricating oil in a more accurate manner.

(Deterioration Suppression Control of Lubricating Oil)

Figure 4:
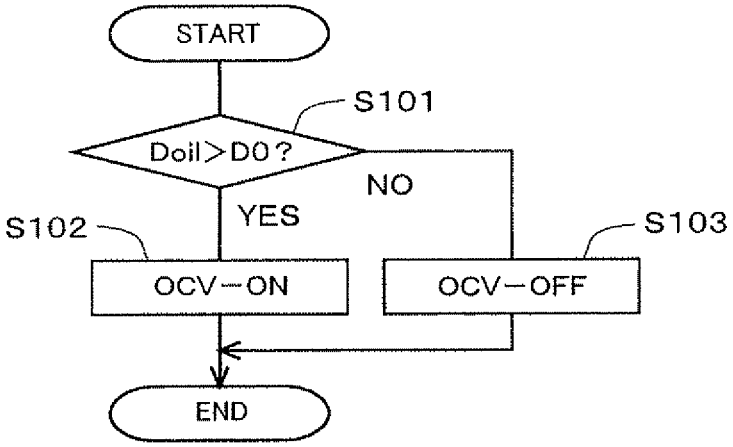
FIG. 4 is a flow chart showing a flow of deterioration suppression control of lubricating oil according to the first embodiment.

Next, the deterioration suppression control of lubricating oil according to this embodiment will be explained based on FIG. 4. FIG. 4 is a flow chart showing a flow of the deterioration suppression control of lubricating oil according to this embodiment. This flow is beforehand stored in the ECU 20, and is carried out by the ECU 20.

In this flow, first in step S101, it is determined, according to the above-mentioned deterioration determination of lubricating oil, whether a degree of deterioration Doil of the lubricating oil is higher than a predetermined level D0. Here, note that in this embodiment, the ECU 20, which carries out this step S101, corresponds to a determination unit according to the present invention.

In step S101, in cases where it is determined that the degree of deterioration Doil of the lubricating oil is higher than the predetermined level D0, then, the processing of step S102 is carried out. In step S102, the OCV 18 is controlled to be in an OCV-ON state. As a result of this, the oil pressure of the oil pump 15 becomes low.

On the other hand, in cases where it is determined in step S101 that the degree of deterioration Doil of the lubricating oil is equal to or less than the predetermined level D0, then, the processing of step S103 is carried out. In step S103, the OCV 18 is controlled to be in an OCV-OFF state. As a result of this, the oil pressure of the oil pump 15 becomes high.

Thus, in this embodiment, when the degree of deterioration of the lubricating oil is higher than the predetermined level, the oil pressure of the oil pump 15 is made lower than that at the time when the degree of deterioration of the lubricating oil is equal to or lower than the predetermined level. With this, the temperature rise of the lubricating oil is suppressed. As a result, the promotion of deterioration of the lubricating oil can be suppressed.

In addition, according to the above-mentioned deterioration suppression control, the temperature rise of the lubricating oil is suppressed due to the decrease of the oil pressure, without cooling the lubricating oil in a forced manner, so it is difficult to cause an excessive drop in the temperature of the lubricating oil. Accordingly, an excessive increase in the viscosity of the lubricating oil can also be suppressed. As a result, the deterioration of fuel economy or mileage can be suppressed.

Moreover, the oil pressure control of the oil pump 15 by means of the OCV 18 is highly responsive, so it is possible to achieve the control for the suppression of deterioration of the lubricating oil at a desired timing. Further, when the oil pressure of the oil pump 15 is made low, the work load thereof will be decreased. As a result, it is possible to improve fuel economy or mileage.

(Modification)

In the above description, the oil pressure of the oil pump 15 is changed in a stepwise manner based on whether the degree of deterioration of lubricating oil is higher than the predetermined level, but in this modification, the oil pressure of the oil pump 15 is made lower in accordance with the increasing degree of deterioration of the lubricating oil. Here, note that in this modification, by changing the degree of opening of the OCV 18, it is possible to change the amount of lubricating oil in the sub-chamber 17*d* of the relief valve 17 in a continuous manner, whereby the oil pressure of the oil pump 15 can be continuously changed.

Figure 5:
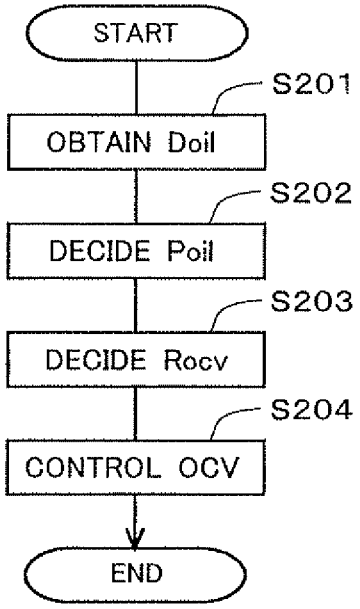
FIG. 5 is a flow chart showing a flow of deterioration suppression control of lubricating oil according to a modified form of the first embodiment.

Next, the deterioration suppression control of lubricating oil according to this embodiment will be explained based on FIG. 5. FIG. 5 is a flow chart showing a flow of the deterioration suppression control of lubricating oil according to this modification. This flow is beforehand stored in the ECU 20, and is carried out by the ECU 20.

In this flow, first in step S201, the degree of deterioration Doil of the lubricating oil is obtained. Here, as a method of obtaining the degree of deterioration Doil of the lubricating oil, there can be exemplified a method in which the degree of deterioration Doil of the lubricating oil is derived based on a difference between a friction calculated from the rotational variation torque at the time of decelerating operation (at the time of fuel cut-off), and a friction which becomes a reference (a fiction at the time when the deterioration of the lubricating oil has not occurred), or a method in which the degree of deterioration Doil of the lubricating oil is derived based on a difference between an amount of fuel injection in the idle operation state and an amount of idle fuel injection which becomes a reference. Here, note that in this modification, the ECU 20, which carries out step S301, corresponds to a deterioration degree obtaining unit according to the present invention.

Then, in step S202, the oil pressure Poil of the oil pump 15 is decided based on the degree of deterioration Doil of the lubricating oil. Here, the relation between the degree of deterioration Doil of the lubricating oil and the oil pressure Poil of the oil pump 15 is set or defined through experiments or the like, and is beforehand stored in the ECU 20 as a map. In the map, the higher the degree of deterioration Doil of the lubricating oil, the lower the oil pressure Poil of the oil pump 15 becomes.

Subsequently, in step S203, the degree of opening Rocv of the OCV 18 is decided based on the oil pressure Poil of the oil pump 15.

Thereafter, in step S204, the OCV 18 is controlled in such a manner that the degree of opening Rocv thereof becomes a value which has been decided in step S203. As a result of this, the higher the degree of deterioration boil of the lubricating oil, the smaller the amount of the lubricating oil in the sub-chamber 17*d* becomes, and the lower the oil pressure of the oil pump 15 becomes.

According to this modification, the higher the degree of deterioration of the lubricating oil, the more the temperature rise of the lubricating oil is suppressed. As a result, the promotion of deterioration of the lubricating oil can be suppressed.

Here, note that in a state where the degree of deterioration of the lubricating oil has increased to some extent, when the oil pressure of the oil pump 15 is made too low, there will be a fear that an oil film shortage may occur. For that reason, in the case of this modification, when the degree of deterioration of the lubricating oil reaches a predetermined upper limit level, a further decrease of the oil pressure of the oil pump 15 may be inhibited.

Second Embodiment

Reference will be made to a second embodiment of the present invention based on FIG. 6. Here, only those which are different from the first embodiment will be explained.

Figure 6:
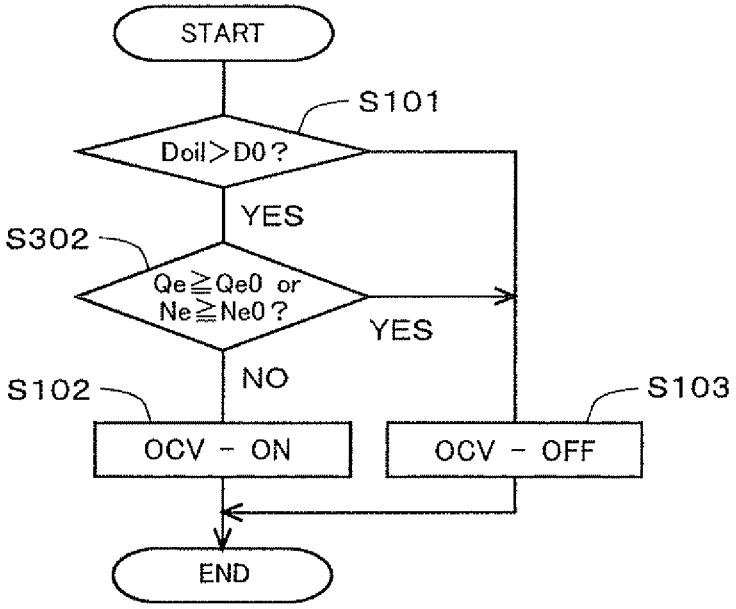
FIG. 6 is a flow chart showing a flow of deterioration suppression control of lubricating oil according to a second embodiment.

FIG. 6 is a flowchart showing a flow of the deterioration suppression control of lubricating oil according to this embodiment. This flow is beforehand stored in the ECU 20, and is carried out by the ECU 20. Here, note that in this flow, a step S302 is added to the flow shown in FIG. 4.

When the oil pressure of the oil pump 15 is made low for the deterioration suppression of lubricating oil, the amount of the lubricating oil supplied to the internal combustion engine 1 is decreased in comparison with the time when the oil pressure is high. For that reason, when the oil pressure of the oil pump 15 is made low during the time the operating state of the internal combustion engine 1 is a high load operating state or a high rotation operating state, there will be a fear that the lubricating oil may run short in the internal combustion engine 1.

Accordingly, in this flow, in cases where an affirmative determination is made in step S101, then in step S302, it is determined whether an engine load Qe of the internal combustion engine 1 is equal to or larger than a predetermined load Qe0, or whether a number of engine revolutions per unit time Ne of the internal combustion engine 1 is equal to or larger than a predetermined number of revolutions per unit time Ne0. And, in this step S302, in cases where an affirmative determination is made, the processing of step S103 is then carried out.

Here, the predetermined load Qe0 and the predetermined number of revolutions per unit time Ne0 are threshold values with which it can be judged that the lubricating oil in the internal combustion engine 1 runs short when the oil pressure of the oil pump 15 becomes low. These predetermined load Qe0 and predetermined number of revolutions per unit time Ne0 can be beforehand set or defined based on experiments, etc.

In another words, in this embodiment, when the engine load of the internal combustion engine 1 is equal to or higher than the predetermined load, or when the number of revolutions per unit time of the internal combustion engine 1 is equal to or more than the predetermined number of revolutions per unit time, the control to make the oil pressure of the oil pump 15 lower is inhibited even in cases where the degree of deterioration of the lubricating oil is higher than the predetermined level. As a result of this, it is possible to suppress the shortage of the lubricating oil in the internal combustion engine 1.

Third Embodiment

Figure 7:
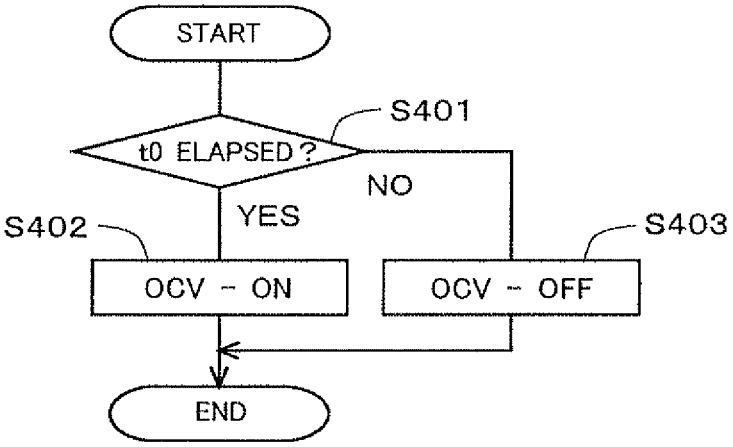
FIG. 7 is a flow chart showing a flow of deterioration suppression control of lubricating oil according to a third embodiment.

Reference will be made to a third embodiment of the present invention based on FIG. 7. Here, only those which are different from the first embodiment will be explained.

In this embodiment, the deterioration suppression control of lubricating oil shown in FIG. 4 is called a first deterioration suppression control. In addition, usually, the OCV 18 is in the OCV-OFF state, i.e., the oil pressure of the oil pump 15 is high.

Then, in this embodiment, a second deterioration suppression control for lubricating oil other than the first deterioration suppression control is carried out. FIG. 7 is a flow chart showing a flow of the second deterioration suppression control of lubricating oil. This flow is beforehand stored in the ECU 20, and is carried out by the ECU 20.

In this flow, first in step S401, it is determined whether a predetermined period of time t0 has elapsed after the OCV 18 was put into the OCV-ON state last time, i.e., after the oil pressure of the oil pump 15 was controlled to be low.

In step S401, in cases where an affirmative determination is made, the processing of step S402 is then carried out. In step S402, the OCV 18 is controlled to be in the OCV-ON state. As a result of this, the oil pressure of the oil pump 15 becomes low.

On the other hand, in step 401, in cases where a negative determination is made, the processing of step S403 is then carried out. In step S403, the OCV 18 is maintained to be in the OCV-OFF state. In other words, the oil pressure of the oil pump 15 is maintained at high pressure.

Thus, in this embodiment, the oil pressure of the oil pump 15 is decreased each time the predetermined period of time elapses, without regard to the degree of deterioration of the lubricating oil. Accordingly, the promotion of deterioration of the lubricating oil can be suppressed to a further extent. In addition, it is possible to further improve fuel economy.

The respective embodiments as described above can be combined wherever possible.

The invention claimed is:

1. A lubrication system of an internal combustion engine comprising:

an oil pump that pressure feeds lubricating oil to be supplied to the internal combustion engine;

an oil pressure control unit that controls the oil pressure of the oil pump; and a determination unit that determines whether the degree of deterioration of the lubricating oil is higher than a predetermined level;

wherein when it is determined by said determination unit that the degree of deterioration of the lubricating oil is higher than said predetermined level, the oil pressure of said oil pump is made lower, by means of said oil pressure control unit, than that at the time when the degree of deterioration of the lubricating oil is equal to or lower than said predetermined level.

2. The lubrication system of an internal combustion engine as set forth in claim 1, wherein when an engine load of the internal combustion engine is equal to or higher than a predetermined load, or when a number of revolutions per unit time of the internal combustion engine is equal to or more than a predetermined number of revolutions per unit time, the control to make the oil pressure of said oil pump lower is inhibited, even in cases where it is determined by said determination unit that the degree of deterioration of the lubricating oil is higher than said predetermined level.

3. The lubrication system of an internal combustion engine as set forth in claim 2, wherein the oil pressure of said oil pump is decreased to or below a predetermined pressure by said oil pressure control unit each time a predetermined period of time elapses.

4. The lubrication system of an internal combustion engine as set forth in claim 1, wherein the oil pressure of said oil pump is decreased to or below a predetermined pressure by said oil pressure control unit each time a predetermined period of time elapses.

5. A lubrication system of an internal combustion engine comprising:

an oil pump that pressure feeds lubricating fluid to be supplied to the internal combustion engine;

an oil pressure control unit that controls the oil pressure of the oil pump; and a deterioration degree obtaining unit that obtains the degree of deterioration of the lubricant;

wherein the higher the degree of deterioration of the lubricating fluid, the lower the oil pressure of said oil pump is made.

6. The lubrication system of an internal combustion engine as set forth in claim 5, wherein the oil pressure of said oil pump is decreased to or below a predetermined pressure by said oil pressure control unit each time a predetermined period of time elapses.

* * * * *